US005788285A

United States Patent [19]

Wicker

[11] Patent Number: 5,788,285

[45] Date of Patent: Aug. 4, 1998

[54] DOCUMENT PROTECTION METHODS AND PRODUCTS

[76] Inventor: Thomas M. Wicker, 6600 Cleary Rd. #2, Livonia, N.Y. 14487

[21] Appl. No.: 666,006

[22] Filed: Jun. 19, 1996

[51] Int. Cl.[6] ..... B42D 15/00

[52] U.S. Cl. ..... 283/93; 285/91; 285/902

[58] Field of Search ..... 283/93, 91, 902, 283/58; 359/566, 568, 569, 567, 577

[56] References Cited

U.S. PATENT DOCUMENTS

| | | | |
|---|---|---|---|
| 1,145,447 | 7/1915 | Todd et al. | 283/58 |
| 3,109,239 | 11/1963 | Wicker et al. . | |
| 3,675,948 | 7/1972 | Wicker | 283/6 |
| 4,033,059 | 7/1977 | Hutton et al. | 283/91 |
| 4,066,280 | 1/1978 | LaCapria | 283/91 |
| 4,143,967 | 3/1979 | Wicker | 355/77 |
| 4,227,720 | 10/1980 | Mowry, Jr. et al. | 283/8 |
| 4,310,180 | 1/1982 | Mowry, Jr. et al. | 283/8 |
| 4,632,430 | 12/1986 | Wicker | 283/91 |
| 4,668,597 | 5/1987 | Merchant | 283/93 |
| 4,684,593 | 8/1987 | Wicker | 430/6 |
| 4,780,397 | 10/1988 | Tsuchiya | 283/93 |
| 5,018,767 | 5/1991 | Wicker | 283/67 |
| 5,149,140 | 9/1992 | Mowry, Jr. et al. | 283/93 |
| 5,171,040 | 12/1992 | Orndoff | 283/93 |
| 5,193,853 | 3/1993 | Wicker | 283/85 |
| 5,374,976 | 12/1994 | Spannenburg | 283/902 |
| 5,447,335 | 9/1995 | Haslop | 283/91 |
| 5,468,581 | 11/1995 | Coe et al. | 430/22 |
| 5,487,567 | 1/1996 | Volpe | 283/72 |

FOREIGN PATENT DOCUMENTS

| | | | |
|---|---|---|---|
| 0 328 173 B1 | 3/1992 | European Pat. Off. . | |
| 0 490 457 B1 | 4/1996 | European Pat. Off. . | |
| 2110730 | 8/1974 | France | 283/91 |
| 1138011 | 12/1968 | United Kingdom . | |
| 2217258 | 10/1989 | United Kingdom . | |
| 90/08046 | 7/1990 | WIPO . | |
| WO93/22145 | 11/1993 | WIPO | 283/902 |

OTHER PUBLICATIONS van Renesse, Rudolf L. ed., Optical Document Security, Chapters 7 and 15, 1994.

*Primary Examiner*—Willmon Fridie, Jr.
*Attorney, Agent, or Firm*—Jaeckle Fleischmann & Mugel, LLP

[57] ABSTRACT

A method and product for making non-reproducible documents, in which a nearly invisible indicia on the document is printed by continuous screened lines of a desired pitch, and a background that will not reproduce by copying that is formed by orthogonal reproduction of positive/negative images of continuous lines to produce broken lines of a desired width and pitch.

12 Claims, 9 Drawing Sheets

DOCUMENT PROTECTION METHODS AND PRODUCTS

BACKGROUND

This invention relates generally to document protection methods and products, and more particularly to methods and products for printing and obtaining original documents that can be readily differentiated from copies made of those documents, whether by color or black-and-white photocopiers, scanning devices, computer printers, or photographic processes. The application is a continuation-in-part of my provisional application Ser. No. 60/019,732 filed Jun. 13,1996 entitled "Optical Deterrant".

Many methods and products have been developed, for example, to deter counterfeiting of valuable documents or financial instruments such as currency, so that unauthorized copies attempted to be made from those documents can be readily distinguished from the originals. Most such documents are prepared by printing or lithography on high quality media such as silk, rice paper, and high contact rag paper, and the printing of original documents may be done either in black-and-white (B&W) or in color, and if in color, either in spot color, colored backgrounds and/or multicolor printing. In the case of color, the tendency has been in the direction of using multiple colors for original documents for aesthetic value, for ease of recognition, and originally for protection from copying by conventional means. The common printing processes of valuable originals, whether in B&W or in color, are intaglio and gravure, among others. These and the other processes mentioned in this application are very well known in the art and will not be discussed in great detail.

Most of the useful examples in the prior art to deter counterfeiting and the like are intended to provide that copies are produced either with a clear moire pattern or with a "latent image" indicia that on the original is invisible or nearly invisible to the naked eye. The term "latent image" is used here not in the photographic sense of an unseen image to be developed after processing by chemical reaction, but to indicate indicia that are printed on originals so as to be nearly invisible to the naked eye.

These and other developments in the prior art for purposes of providing document protection are disclosed in the patent literature, as for example, in U.S. Pat. No. 5,018,767 issued May 28, 1991; U.S. Pat. No. 5,193,853 issued Mar. 16, 1993; and U.S. Pat. No. 3,675,948 issued Jul. 11, 1972; and U.S. Pat. No. 4,143,967 issued Mar. 13, 1979, all to Ralph C. Wicker; in U.S. Pat. No. 4,227,720 issued Oct. 14, 1980 and U.S. Pat. No. 4,310,180 issued Jan. 12, 1982 both to William H. Mowry, et al, as well as U.S. Pat. No. 5,149,140 issued Sep. 22, 1992 to Mowry et al; and in U.S. Pat. No. 5,487,567 issued Jan. 30, 1996 to John R. Volpe. All of these patents disclose various means for providing methods and products to enable copies of documents to be distinguished from the originals, as for example, by a "large dot-small dot pattern", a "close line-spaced pattern", and images or indicia which are screen printed at minutely varied spaces and/or angles on the originals and are intended to produce a highly visible moire pattern effect on the unauthorized copies. In this specification, I use the words "print" and "printing" to refer to the making of an original document regardless of the techniques used and the words "copy" and "copying" to refer to the making of copies from an original.

It is well known, however, that copier and computer scanner-printer technology has become even more sophisticated since the development of the prior art in document protection. The goal of copier technology if not already achieved has been, especially in desktop publishing and the like, to obtain copies as good as an original. "What you see is what you get" in color documents has become very achievable in copier and duplicator equipment including scanning input devices, and even desk-top computers have become sufficiently sophisticated in color reproduction, including color matching of copies to color standards such as the PANTONE® Color Matching System.

Many if not all of the document protection methods and products were developed before this very significant improvement in copier and computer reproduction technology, and have been found not be as effective in the newer color reproduction technology especially on color copiers with a "photo" setting that intentionally copies a document in an "unsharp" focus so as to give the effect of a continuous tone image, the effect of which is to defeat the precise line variation between the copier scanner and the security pattern on the document original. Developed at the time of limited copier and printer advancements, these prior art techniques for document protection may not work as reliably against the many forms of copier/duplicator and computer scanner/output equipment now or soon to be available.

Thus it has become imperative for purposes of document security and safety that further improvements in the area of document protection be found, especially where there is a need to prevent copying or duplicating of valuable originals without readily distinguishing the copies from the originals.

SUMMARY OF THE INVENTION

My invention overcomes many of the shortcomings of the prior art which are limited in application because of the potential availability of newer and different copiers that can defeat the techniques and methods used by the prior art. My invention follows the basic plate making and printing techniques used by the prior art in order not to require substantial capital or new equipment by the vast number of printers that print such originals, and is a significant improvement over the "large dot-small dot" and the differently angled continuous line techniques now available.

It is therefore an object of the invention to provide a significantly improved method for printing originals to defeat unintended copying of documents by use of available copier/duplicator and computer techniques.

It is another object of the invention to produce a document paper on which valuable documents can be printed, which either substantially defeats replication by copiers/duplicators and computer systems, or permits authorized replication only in a desired fashion.

DRAWINGS

These and other objects and advantages of the present invention can be determined from the following description of preferred embodiments according to the invention and the accompanying drawing in which like numbers refer to like elements and wherein.

Figure 7:
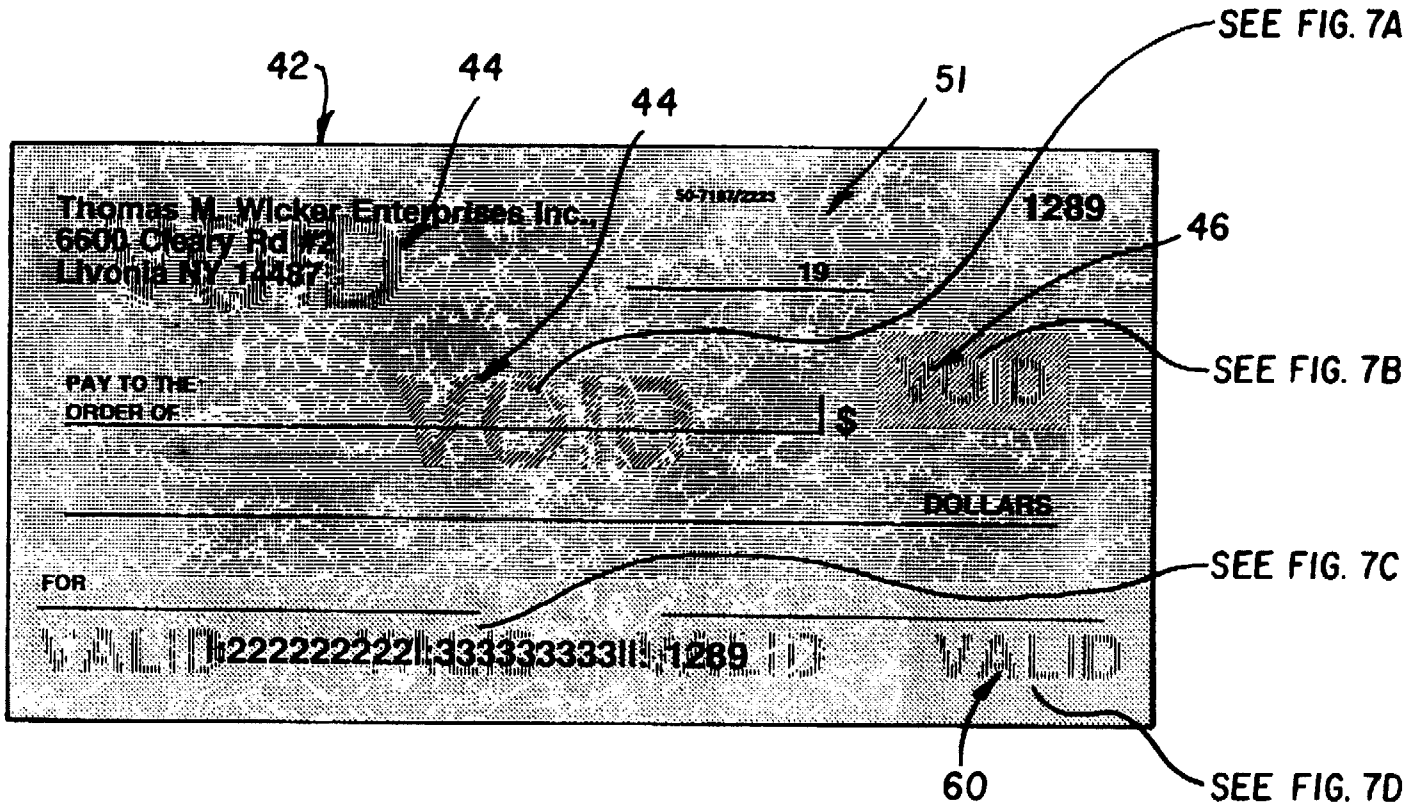
FIG. 7 is an example of a paper product incorporating the present invention.
Figure 7A:
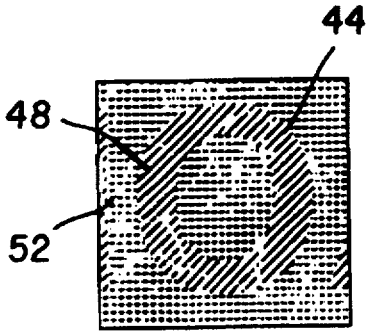
Figure 7B:
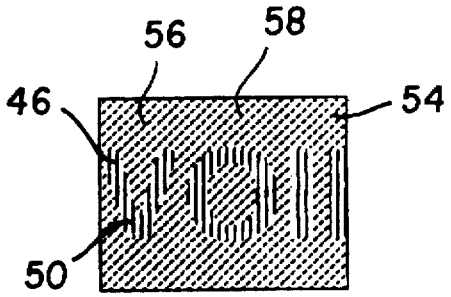
Figure 7C:
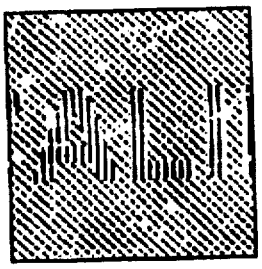
Figure 7D:
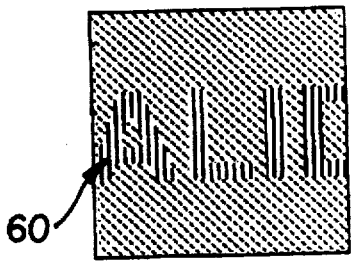
Figure 7E:
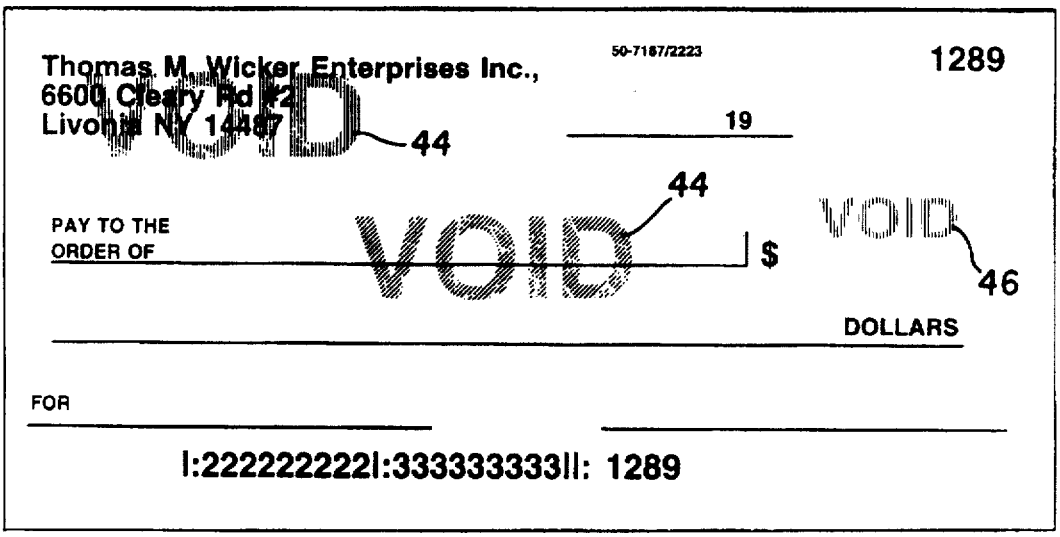
Figure 7F:
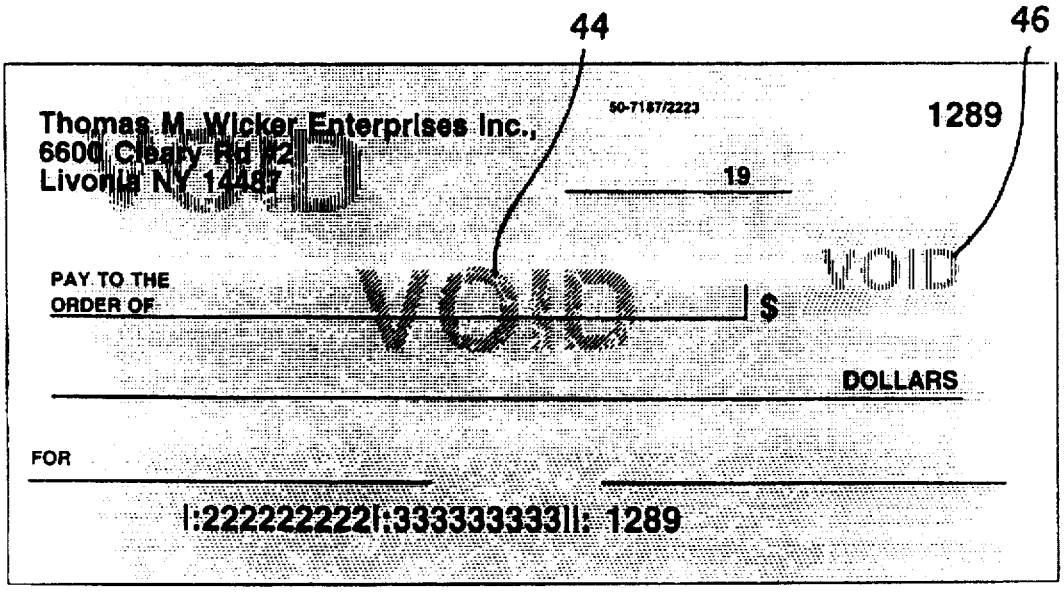

FIGS. 7*a*, 7*b*, 7*c* and 7*d* are enlarged views of sections of the product of FIG. 7 to illustrate specific aspects of the present invention; and FIGS. 7*e* and 7*f* are copies made from the paper product shown in FIG.7.

DETAILED DESCRIPTION OF PREFERRED EMBODIMENTS

Figure 1:
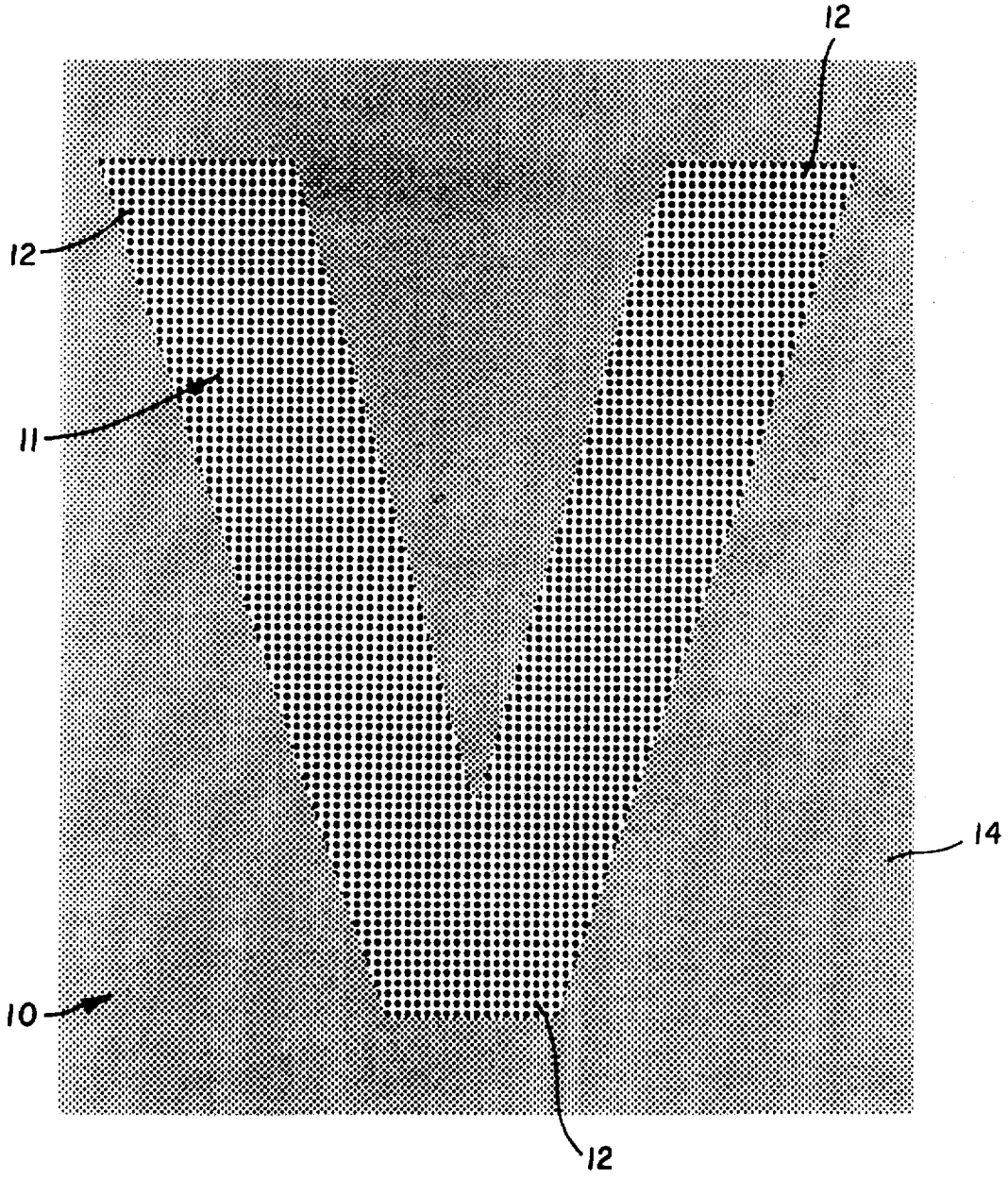
FIG. 1 prior art
FIGS. 1 and 2 are examples of the prior art in the field of this invention.
Figure 2:
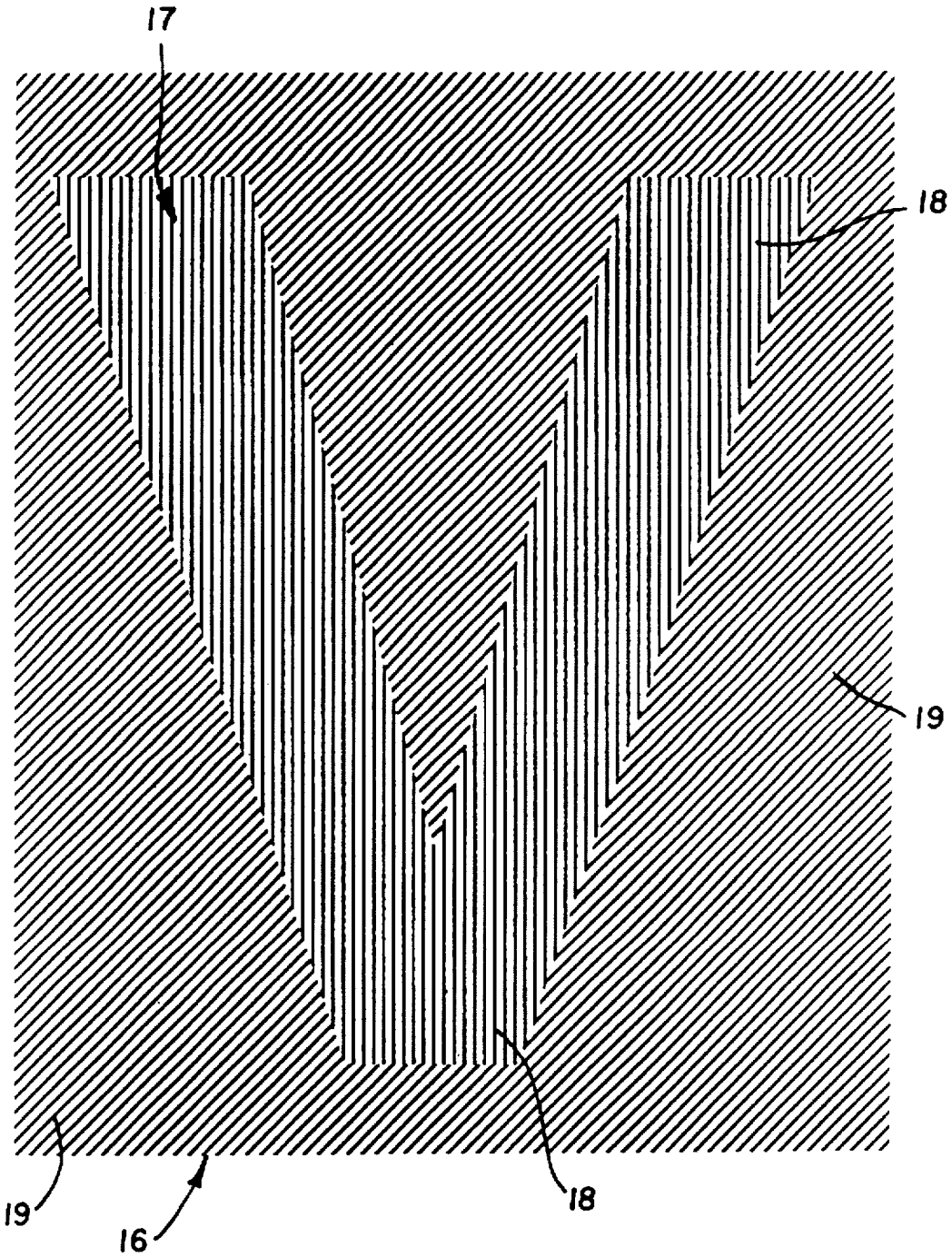
FIG. 2 prior art

As an example of the prior art, FIG. 1 represents a "large dot-small dot" pattern printed on a "security paper" 10, disclosed for example in U.S. Pat. No. 4,310,180 in which the desired "latent image" indicia 11 to be made visible in copies of the original document is printed in large dots 12 by appropriate well-known half-tone screen techniques, whereas the smaller dots 14 also printed by half-tone screens are patterned with the intent of their not being visible on copies produced by copiers. Also a pantograph or camouflaged pattern of halftone screen dots often is added to aid in disguising the desired indicia on the original document. FIG. 2 on the other hand illustrates a security paper 16 form in which the desired "latent image" indicia to 17 be printed is formed by screened continuous lines 18 at one angle and a background, also formed of continuous lines 19, but at a different angle from the indicia intended to be visible when printed, as shown for example in U.S. Pat. No. 5,487,567. In this case, the lines 18 illustrating the hidden indicia are drawn at an angle with a pitch of 65 lines per inch and approximately 0.001 inch in width, and the background pattern is formed by horizonal lines 19 spaced more closely at a higher pitch. In this latter case, it has been possible to produce background patterns without using a separate camouflage overlay, as is often used with the "large dot-small dot" technique, but patterns can be introduced as is known by the prior art to the technique of FIG. 2 to resemble the pantographs.

Whereas the examples shown in FIGS. 1 and 2, as well as the other examples of the prior art such as the moire pattern methods described in the identified U.S. patents, have been useful to date to discourage random counterfeiting, I have found a very surprising and unexpected result from a relatively inexpensive modification of the known techniques that will produce very highly desirable results and enable the production of original valuable documents that can defeat copying from an even larger number of available copiers/duplicators and computer scanner/output devices.

Figure 3:
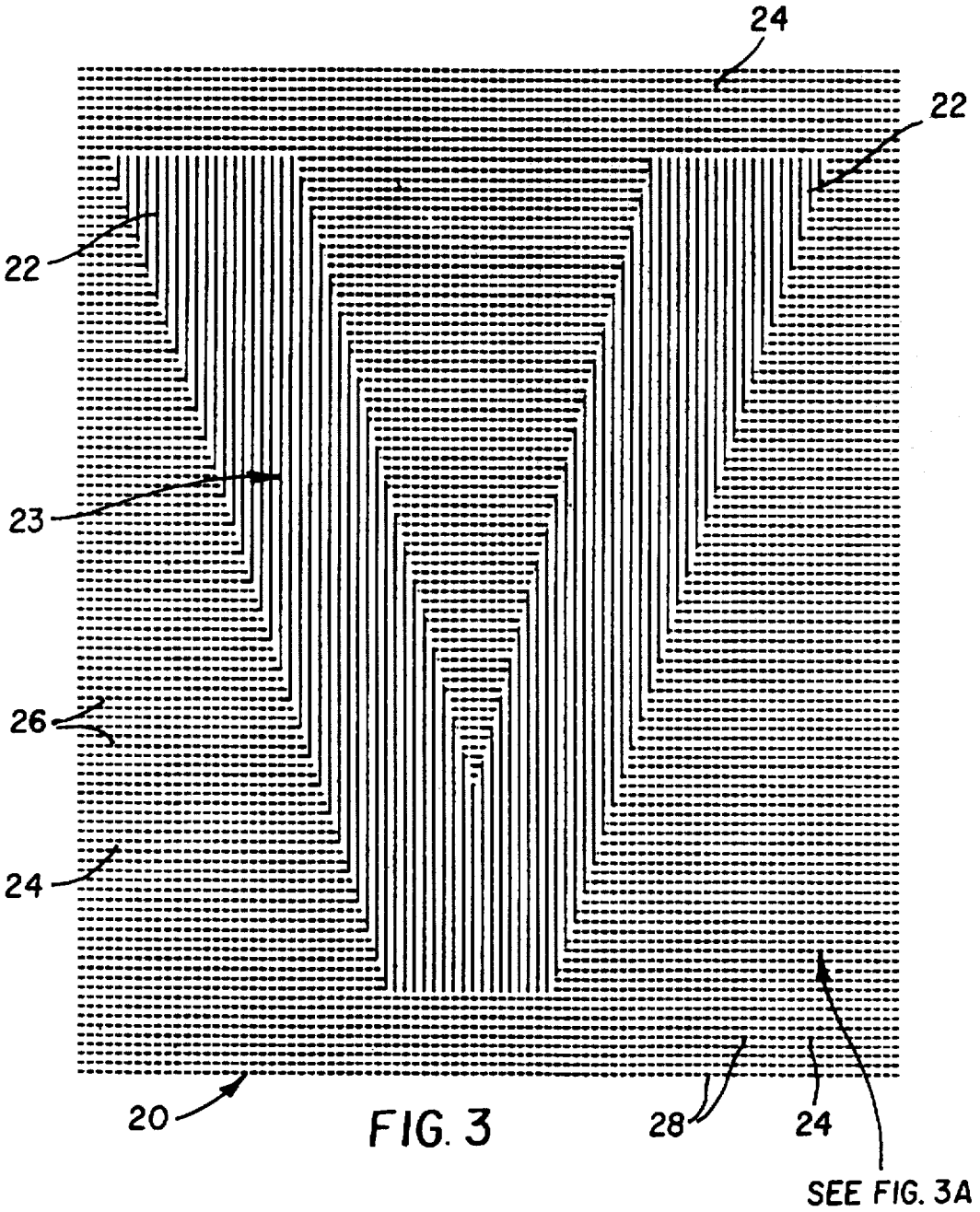
FIG. 3 is an enlarged version of a portion of a document printed according to a preferred embodiment of the present invention.
Figure 3A:
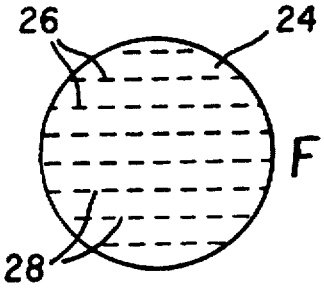
FIG. 3A is a further enlarged view of a portion of FIG. 3.

According to a preferred embodiment of my invention, as shown in FIG. 3 and FIG. 3A I have provided an original document 20, a portion of which is illustrated, having continuous lines 22 for the indicia 23 that is the latent image that is to become visible to the naked eye after copying. The continuous lines 22 extend across the intended visible indicia 23, in this case the word "VOID" although any word or graphic indicia will work. The lines 22 can have a width of between about 0.0005 and about 0.015 inches, but preferably they are of uniform width between about 0.0015 and about 0.008 inches. The overall pitch or line spacing of lines 22 may be between 50 to 200 lines per inch, although the preferred range is from about 75 to about 140 lines per inch and an ideal of from about 90 to about 133 lines per inch. As will be described later with reference to FIG. 7, I have also found that according to my invention the printing of the lines 22 indicia 23 can but need not be repeated in more than four orthogonal angles of say 5°, 45°, 95° and 135° relative to the vertical document axis each to enhance document protection during copying, regardless of the scanning frequency of the copying equipment or the position of the original on the copier platen.

According to my invention, the presentation of the continuous lines 22 for the latent image of the indicia 23 is combined with broken lines 24 for the background between the indicia 23 that are specially made in accordance with this invention. As illustrated, they are shown as shorter lines 26 with spaces 28 to be described more fully, but at an angle of preferably between about 10° and about 170° relative to the continuous lines 22 of the latent image indicia 23 and more specifically from about 30° to about 120° relative to the continuous lines.

When seen by the naked eye, the continuous lines 22 of the latent image indicia 23 and the shorter lines 26 of the background will appear to present a continuous pattern. The shorter lines 26 are designed so as not to be reproduced in copying, whether by making substantial portions of the entire document 20 invisible on copies or giving greater prominence to the desired indicia 23 made visible on the copies. Preferably the shorter lines 26 are of the same width as the continuous lines 22 but they can vary in width relative to the continuous lines 22 up to a 1:6 ratio but most preferably between about a 1:1 ratio and about a 1:2 ratio. The pitch or line spacing between the broken lines 24 preferably is different from the pitch of the continuous lines 22, as for example 133 lines per inch for the broken lines 24 and 90 lines per inch for the continuous lines 22, but they also can be generally selected from within the same overall optical range of line pitch as the continuous lines, i.e., 50 to 200 lines per inch. As will be seen in FIG. 7, the broken lines 24 preferably also use a variety of printing angles (up to four) in the document original, for example 5°, 45°, 90° and 135°.

Figure 4:
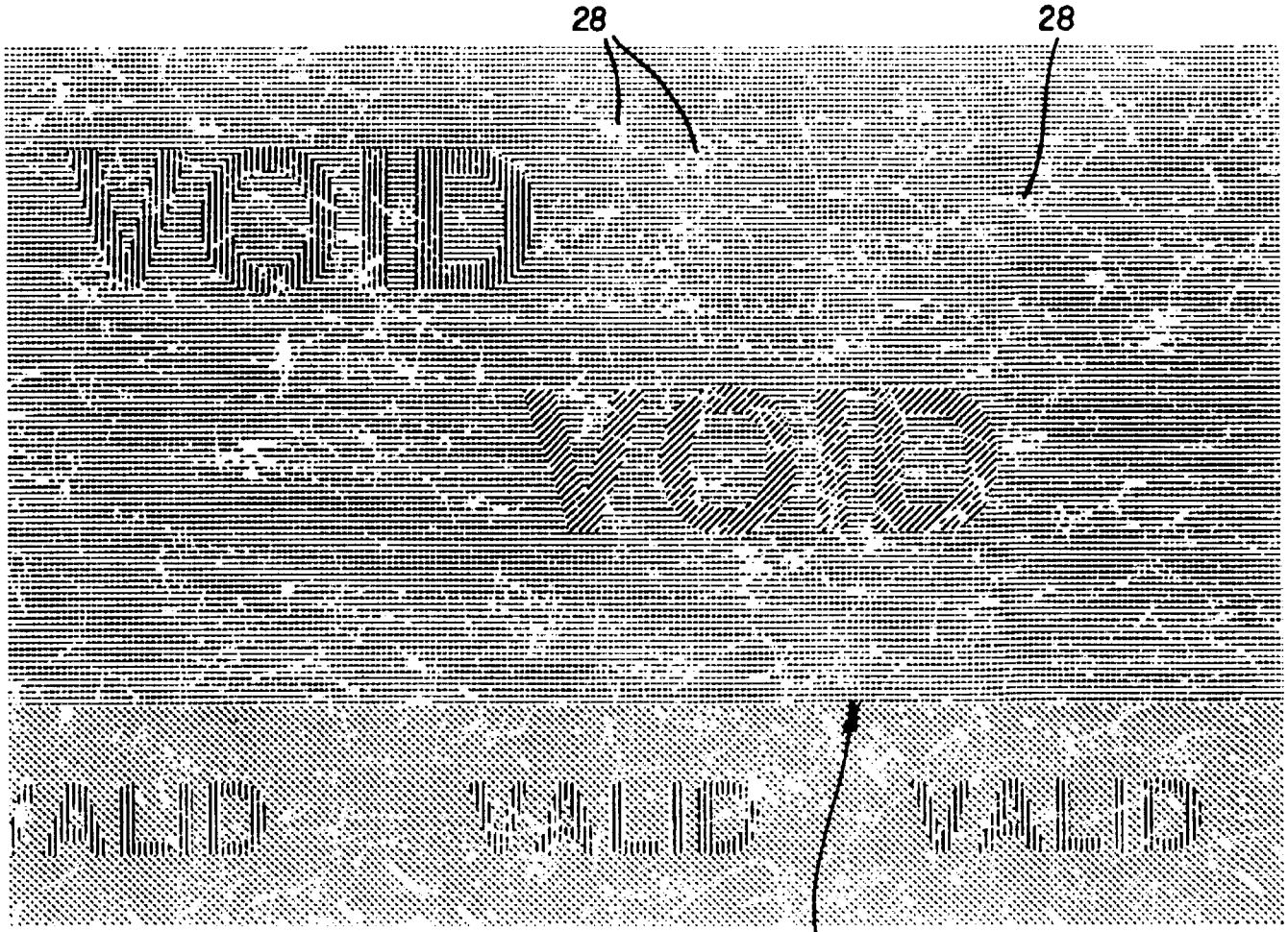
FIGS. 4, 5 and 6 are enlarged views of alternate embodiments according to the present invention.
Figure 5:
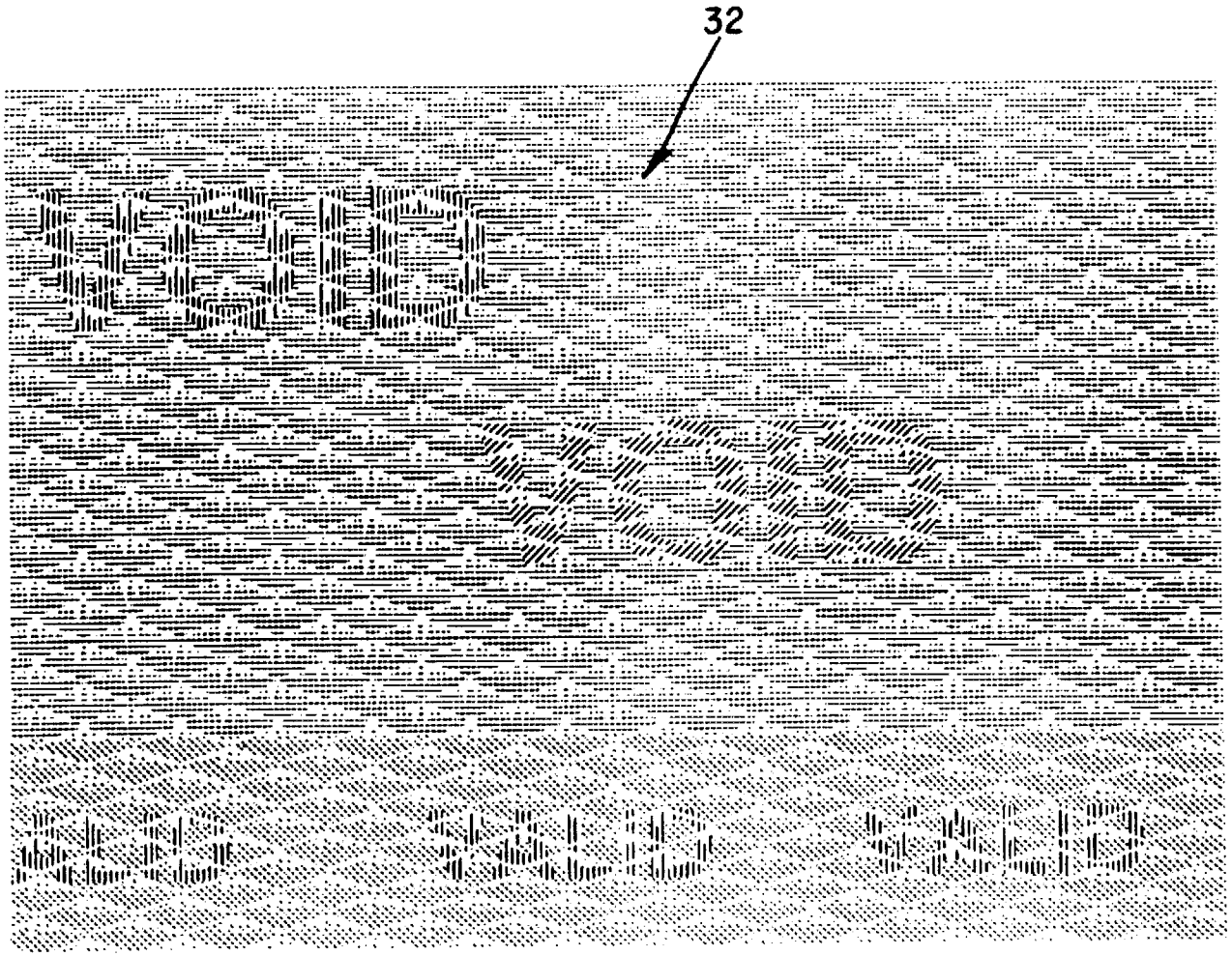
Figure 6:
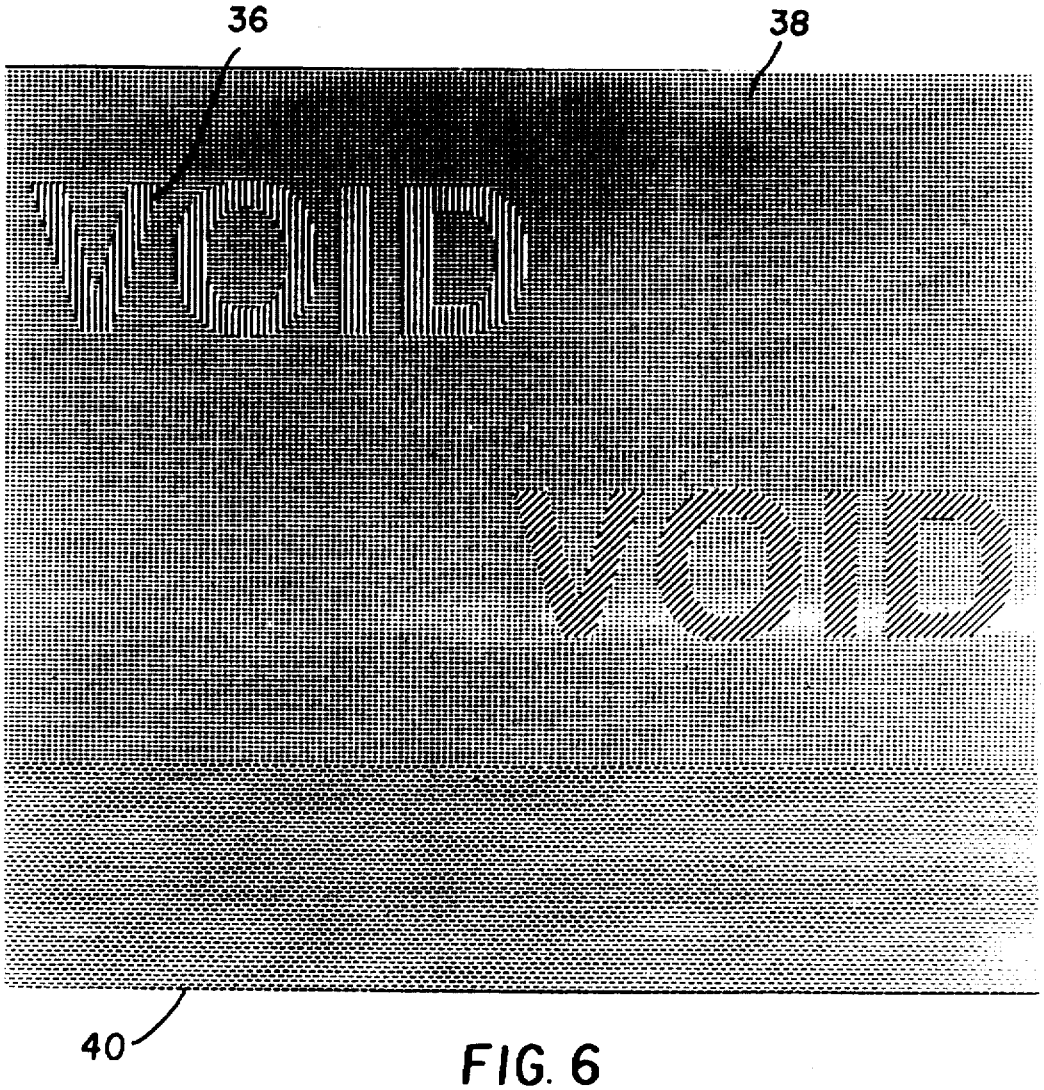

In addition, as seen in FIGS. 4, 5 and 6, it is possible to break up the patterns of both of the continuous lines 22 and the short lines 26 as seen in FIG. 4 by random sized white areas 28, for example, to create an overall cloud-like pattern on original 30, or as seen in FIG. 5 a regular overlay pattern 32, in this case a diamond pattern, to further disguise the protection system on the document paper 34. My invention is sufficiently flexible to use other overall designs as well, as shown for example in FIG. 6 in which the pitch and angles of lines 36, 38 remain the same as with FIG. 3, but the print density from the top of the document 40 to the bottom is decreased from about 20% to about 5% by gradually changing the line thickness from about 0.002 inches to about 0.0005 inches to present a continuous dark to light background. As the word(s) or graphic in the latent image indicia is sufficiently large compared to the random areas or the repetition in the pattern, these occasional breaks in the continuous lines of the latent image indicia, or the variation in present density written the ranges disclosed, will not defeat the intent of the invention.

According to the preferred embodiment of the present invention, the broken lines 24 are made by producing separate positive and negative images of continuous lines of the desired width and pitch and then orthogonally placing the negative image against the positive image and making a new image from the composite images that will result in the short lines 26 of the same pitch spaced from each other in the same broken line 24 by spaces 28 about the width of each of those lines 26. Depending on line width and pitch, the length of each space 28 between any two of the short lines 26 could vary from about 10% to about 45% of the length of each of the short lines 26, with about 28% seeming to work the best.

Based on my experimentation, the prior art as shown above in FIGS. 1 and 2 seem only to be able to be printed in about 184 printed colors and then can prevent copying only for about 50% of the B&W copiers available and especially do not seem to work in the photo or "unsharp" mode of color copiers. In the case of my invention, up to 600 Pantone® colors can be used, often with as little as 1% black in the color, working with virtually all copiers, virtually all color copiers both in the sharp and the photo modes, and on known desktop publishing equipment.

FIG. 7 illustrates a document 42 using my present invention, in which the latent image indicia 44, 46 are randomly spaced in this case two different angles or 5° and 45° from the page axis, using continuous lines 48, 50 of 0.002 inches in width and a pitch of 90 lines per inch. The background 51 or broken lines 52, 54 are also about 0.002 inches in width and about 133 lines per inch, with the spaces 56 representing about 28% of the overall length of each short line 58 depending on the screened material used to form the images 44, 46. The angles of lines 52, 54 are shown in FIGS. *7a* and *7b* at about 45° from their adjacent indicia lines 48, 50.

In addition, it also is possible to use my invention by reversing the screen layouts such that the desired word 60 is visible on the original document 42, as for example the word "VALID", and which word does not appear on the copy. In this case the word 60 uses 133 lines per inch and the background 90 lines per inch.

FIG. *7e* is an example of a normal copy 62 attempted to be made by normal settings from a typical copier in which the background 51 and the visible word 60 did not print but the latent image indicia 44, 46 became visible. With an attempt to darken the copy by increasing the toner deposit setting on the copier, as shown in FIG. *7f*, the copy still does not produce the visible word 60 and continues to distinguish the indicia 44, 46 from the background 51.

The latent images for the indicia of the original document of my invention is printed by, for example, photographing a negative of a solid of the desired indicia, say the word "VOID", through a line screen of 90 lines per inch, each about 0.002 inches in width. A second negative is made from the composite image the background pattern as produced with the composite negative-positive film as described above in further combination with the solid indicia which then is printed with the original continuous line indicia to form a pattern in positive to form the composite image by which the entire document can be printed from plates made from the film. Various ways in making these films and plates are well known in the art, including the use of color separations and/or split ink fountains to print in multicolors.

The illustrations show straight line patterns for the backgrounds, but curved line patterns may also be used provided the width and pitch of the lines follow my invention. Similarly, the short lines need not all be in the same two directions within the pattern on the document but as shown in FIG. 7 can be patterned at different angles even adjacent to each other to further the camouflage the indicia 44, 46, varied up to the preferred four angles throughout the pattern background 51 whether or not adjacent to the latent images of the indicia 44,46.

The printing technique according to my invention as disclosed also is very useful for authorized copying because the even background pattern on an original will not reproduce by a conventional copier, and will result in a substantially clear background. Thus, it may be desirable in document printing to include a latent image indicia with a background pattern of my invention on the original document paper stock, as for example the repeated word "COPY" as the indicia so that when legitimate distribution copies are made of that document, the copies can have a clear uniform background but still easily distinguished from the original in distribution because of the visibility of the repeated word "COPY".

The images of the indicia and the images of the camouflage background can be related to each other in a configuration or design which can drawn by hand, computer formed, or composed on film or printing plates, all as known to those skilled in the art, or, as is also known, after creation converted to an electronic program or disk to transfer images direct to plate or to print using the programmer disk on any laser or other conventional output device. Although not necessary, pantographs or designs can be overprinted or reversed out of the pattern as for example the cloud pattern identified earlier. For optimum safety, the invention can also be used in combination with other methods, such as using a visible image to produce a moire pattern as disclosed, for example in U.S. Pat. Nos. 5,018,767 and 5,193,853, the latter of which discloses that the lines may be at a desired pitch deliberately selected so as to vary minutely from the pitch of the scanning trace of known copying machines and video opticons.

Although my invention is described by reference to specific preferred embodiments, it is clear that variations can be made or other material used without departing from the spirit of the invention as claimed.

I claim:

1. A press printed document which is counterfeit resistant to known electronical optical copiers and scanners, comprising a print surface; a first indicia printed on at least a portion of the print surface and formed by a set of continuous lines of substantially uniform pitch throughout the first indicia; a second indicia printed on at least a portion of the print surface adjacent to the first indicia and formed by a set of broken lines of substantially uniform pitch throughout the second indicia, each broken line defined by a plurality of coaxial short line segments of substantially equal width and equal length and by spaces between the short line segments the spaces being of substantially equal length and each of which has a length within a range from about 10% to about 45% of the length of each of the short line segments; in which the continuous lines are at angles to the broken lines and in which the copiers and scanners substantially reproduce the first indicia but not the second indicia.

2. The document according to claim 1 in which the continuous lines are of the same width as the coaxial short line segments.

3. The document according to claim 1 in which the length of the spaces between adjacent short line segments of each broken line is approximately equal to the width of the short line segments.

4. The document according to claim 1 in which each of the continuous lines has a width from about 0.0005 inches to about 0.015 inches.

5. The document according to claim 1 in which the uniform pitch of the set of broken lines is from about 50 lines per inch to about 200 lines per inch.

6. The document according to claim 1 in which the ratio in the width of the short line segments to the width of the continuous lines is from about 1:1 to about 1:6.

7. The document according to claim 1 in which the continuous lines have a uniform width from about 0.0015 inches to about 0.008 inches.

8. The document according to claim 1 in which the uniform pitch of the broken lines is from about 75 lines per inch to about 140 lines per inch.

9. The document according to claim 1 in which the ratio in the width of the short line segments to the width of the continuous lines is from about 1:1 to about 1:2.

10. The document according to claim 1 in which continuous lines are printed in up to four orthogonal angles of about five, forty-five, ninety-five and one-hundred thirty-five degrees relative to a vertical axis of the document.

11. A press printed document which is counterfeit resistant to known optical copiers and scanners, having a print surface and comprising:

a. a first indicia printed on at least a portion of the print surface and formed by a plurality of continuous printed lines of substantially uniform pitch throughout the indicia, each of the continuous lines having substantially the same width in which the width is between about 0.0005 inches to about 0.015 inches;

b. a second indicia printed on at least a portion of the print surface and formed by a plurality of broken lines, the lines having a substantially uniform pitch throughout the second indicia within the range from about 50 lines per inch to about 200 lines per inch, in which each broken line is defined by a plurality of coaxial printed short line segments of substantially equal width and substantially equal length and unprinted spaces between the short line segments in which each of the spaces is approximately equal in dimension to the width of the short line segments;

c. the continuous lines being printed at angles to the broken lines and the ratio in the width of the short line segments to the width of the continuous lines being from about 1:1 to about 1:6; and d. in which known copiers and scanners substantially reproduce only the continuous lines.

12. The document according to claim 11 in which continuous lines are printed in up to four orthogonal angles of about five, forth-five, ninety-five and one hundred thirty-five degrees relative to a vertical axis of the document.

* * * * *